US005099773A

United States Patent [19]

Codos

[11] Patent Number: 5,099,773

[45] Date of Patent: Mar. 31, 1992

[54] METHOD OF MANUFACTURE FOR CORDED AND PAINTED QUILT

[75] Inventor: Richard N. Codos, Warren. N.J.

[73] Assignee: Pathe Computer Control Systems Corporation, Irvington, N.J.

[21] Appl. No.: 592,603

[22] Filed: Oct. 4, 1990

[51] Int. Cl.[5] ..... A06Q 1/00

[52] U.S. Cl. ..... 112/266.1; 112/420; 112/439; 434/84

[58] Field of Search ..... 112/262.1, 439, 17, 112/117, 119, 266.1, 121.11, 139, 420; 2/244, 243 R; 434/81, 84, 95

[56] References Cited

U.S. PATENT DOCUMENTS

| | | | |
|---|---|---|---|
| 1,558,866 | 10/1925 | Greenstein | 112/266.1 |
| 1,563,185 | 11/1925 | Gouled | 112/266.1 |
| 1,581,936 | 4/1926 | Lehmann | 112/439 |
| 1,850,115 | 3/1932 | McCarthy | 434/95 |
| 1,893,422 | 1/1933 | Levenson | 2/244 |
| 2,371,153 | 3/1945 | Connelly | 434/84 |
| 3,771,479 | 11/1973 | Mavis | 112/439 |
| 4,497,269 | 2/1985 | Schneider et al. | 112/262.3 |
| 4,654,044 | 3/1987 | Gilardone, Jr. | 112/266.1 |
| 4,688,502 | 8/1987 | Kreiger | 112/439 |
| 4,748,920 | 6/1988 | Stutznäcker | 112/266.1 |

FOREIGN PATENT DOCUMENTS

| | | | |
|---|---|---|---|
| 1089980 | 11/1967 | United Kingdom | 434/95 |

*Primary Examiner*—Werner H. Schroeder
*Assistant Examiner*—Amy Brooke Vanatta
*Attorney, Agent, or Firm*—Klauber & Jackson

[57] ABSTRACT

A process for producing a painted, cord-bordered design on a comforter, includes the steps of superimposing a facing sheet of material on a layer of batting material which is on a backing sheet, positioning a cording material on the facing sheet in a predetermined pattern by use of a quilting machine, stitching the cording material immediately after positioning, the stitching going through all the layers of the comforter, removing the work piece from the quilting machine and painting those areas of the desired design which are bordered by the cording material.

32 Claims, 2 Drawing Sheets

METHOD OF MANUFACTURE FOR CORDED AND PAINTED QUILT

BACKGROUND OF THE INVENTION

The present invention relates to a method for the consistent and rapid reproduction of a painted design bordered with cording on a quilt.

Conventionally, the manufacture of quilts and comforters involves the assembly of a facing sheet and a backing sheet of material sewn together along their perimeters to form a bag. The bag is stuffed with batting and placed on a quilting machine or similar bulk sewing apparatus for the final sewing operation, where it is stitched once through all the layers in a predetermined pattern. Today, much of the quilt manufacturing process has been automated, for example, quilting machines can be directed by computer to perform stitch patterning and control.

However, automated methods of production have not been applied to the production of quilts and comforters that are hand painted.

Hand painted comforters and quilts have a decorative pattern which has been designed and painted by an artist on a facing sheet. Subsequently, the facing sheet is sewn to a backing sheet to form the bag, which is then stuffed with batting and sewn together such that the thread follows the outline of the painted design. The sewing operation must be manually performed with a human operator following the perimeter of the design with a stitching machine, thereby accentuating the design.

Naturally, the manual operation required by the above stitching process substantially increases the time and cost of production above that of a conventional, non-painted quilt or comforter. For example, production time can range from three-quarters of an hour to several hours depending upon the complexity of the design. Furthermore, the high costs associated with individually designed, hand painted quilts has made the mass-marketing of these decorative products difficult. The cost to the consumer of a quilt made according to prior art processes can range from about $150.00 to about $900.00, again depending on the complexity of the design.

An additional disadvantage to the known process is the relatively low level of consistency and uniformity between work pieces. This is largely attributable to the low reproducibility of handiwork. The inevitable variations and inconsistency of design and quality of the quilts are subject to the consistency of the artist and the outline quilter. This lack of consistency has also contributed to making the products difficult to sell through catalog houses or other mass merchandising techniques. Specifically, the manufacturing differences and inconsistencies make it difficult for a catalog house to deliver products to its customers which are consistent with the photographs in their catalogs.

Related to the latter disadvantage, there is also a further disadvantage in guiding the border stitching by hand because there may be gaps of unpainted surface between the stitching and the edge of the design. These gaps can negatively affect the accentuation of the design.

Reversing the order of steps in the conventional painted quilt process described above would result in other disadvantages. For example, if a quilt is first stitched according to the desired pattern and the paint is subsequently applied, the paint applicator would necessarily have to be very slow and cautious. Even with an excess of caution, the paint would migrate out of the intended areas. As further examples, the applicator's brush may slip, excess paint may be applied, or areas near the stitching which should be painted may be missed.

In this regard, Applicant has become aware of various prior art references which fall essentially into four categories.

The first category relates to machines and methods for stitching predetermined patterns, as disclosed in U.S. Pat. No. 4,497,269 to Schneider et al. This patent discloses quilt embroidering equipment where the sewing head remains fixed and the remainder of the apparatus shifts the work piece past the sewing head in the predetermined embroidery pattern.

U.S. Pat. No. 4,526,116 to Mannel discloses an embroidery machine which utilizes recordation of the desired embroidery pattern as a program on a storage element wherein the specific motif has been converted to half tones which are accurately reproducible by computer generation.

U.S. Pat. No. 4,748,920 to Stutznacker relates to a sewing device having a fixed head which likewise utilizes computer storage and control to confirm and standardize the dimensional data in a contour-stitching operation. However, with the above patents, there is no painting of the fabric.

The second group of patents relates to various cording and/or quilting machines. Thus, U.S. Reissue Pat. No. 24,305 and U.S. Pat. No. 2,813,501, both to Shotsky, are reflective of very early generation quilting machines. See also U.S. Pat. No. 3,695,196 to Codos.

Processes for coloring embroidered designs, which are in the third category, are disclosed in U.S. Pat. Nos. 1,563,185, to Gouled and 4,654,044 to Gilardone, Jr. Of these, the latter is of marginal interest, as it relates to the sequence of identifying a pattern by the disposition of an embroidery thread, followed by the application of a colored pattern, in this instance, by the sublimation of a dye from a transfer printing element. However, the thin threads will not prevent migration or the like of paint in a coloring operation.

The last category contains U.S. Pat. Nos. 2,371,153 to Connelly and 2,450,127 to Gardener et al. which disclose conventional artistic assemblies. In the instance of Connelly, the invention relates to the use of raised lines to define the figures or objects to be painted, for the purpose of providing a barrier for overspill of a child's watercolor paints. Gardener et al. defines a kit with a base having a series of different patterns disposed thereon and identified by various lines and numbers. Depending upon the specific pattern that is to be followed and the number and color to be utilized, the player will select certain colored segments or pieces for disposition over the pattern. When fully assembled within the frame, the picture may differ depending upon the initial color and pattern choices made.

OBJECTS AND SUMMARY OF THE INVENTION

One object of the present invention is to increase consistency and accuracy in the reproduction of painted, stitch-bordered designs on quilts.

Another object of the present invention is to dramatically reduce the sewing time of quilts having painted, stitch-bordered designs.

Additionally, it is an object of the present invention to reduce the time necessary for painting quilts having painted, cord-bordered designs.

Still another object of the present invention is to reduce sloppy paint application.

Yet another object of the present invention is to help prevent the migration of paint from one area of the design to another area of the design where that paint is undesirable.

A further object of the present invention is to reduce the misapplication of paint caused by excess paint on the applicators.

Still a further object of the present invention is to provide a relatively easy way to alter the aesthetic appearance of a quilt by using different cord colors with the sam painted design.

Yet a further object of the present invention is to reduce the incidence of bare, unpainted spots near the cording.

The present invention relates to a new manufacturing process for painted quilts which achieves a high degree of consistency of design, coloration, and outline quilting. The process involves initially overlaying the facing sheet, batting material and backing sheet, and then defining the outlines of a predetermined design on the surface of the facing sheet with some decorative raised bordering material, such as a length of cord which is sewn on the facing sheet. This sewing operation also results in securement of the layers together. The cord is positioned and attached with a computer-guided drum quilter in accordance with the particular predetermined design that has been programmed into the machine. The stitched layers are subsequently removed from the quilting machine and the decorative patterns defined by the cord are then preferably painted by an automated paint machine. The raised cording prevents paint from being misapplied either through migration from one area to another, from sloppy painting, accidental slips, or from excess paint on the brushes. Additionally, the cording may serve as a guide for an automatic painter which is guided by a tactile or visual sensor to apply a decorative coating within the pattern defined by the cording border.

By the present invention, the layout of the cording may be reproduced within machine tolerances of approximately ±0.005 inch. The stitching time for first applying the cording by machine is reduced to about five to ten minutes, from a conventional range of three-quarters of an hour to several hours by hand. Moreover, the painting process is no longer painstaking and can be achieved in a period of time as little as fifteen minutes or less.

The cording as applied herein has an aesthetic value in that it may be used to accent various sections of the design. For example, changes in the cording color may result in dramatically different design effects without actually changing the design or the paint color. In addition, unlike the prior art painting processes for quilting which can leave some space unpainted between the stitching and the paint, the present invention reduces any spacing between the cording and the edge of the paint.

BRIEF DESCRIPTION OF THE DRAWINGS

For a more complete understanding of the present invention, reference may be had to the following detailed description considered in conjunction with the accompanying drawings, in which.

DETAILED DESCRIPTION OF THE PREFERRED EMBODIMENTS

Figure 1:
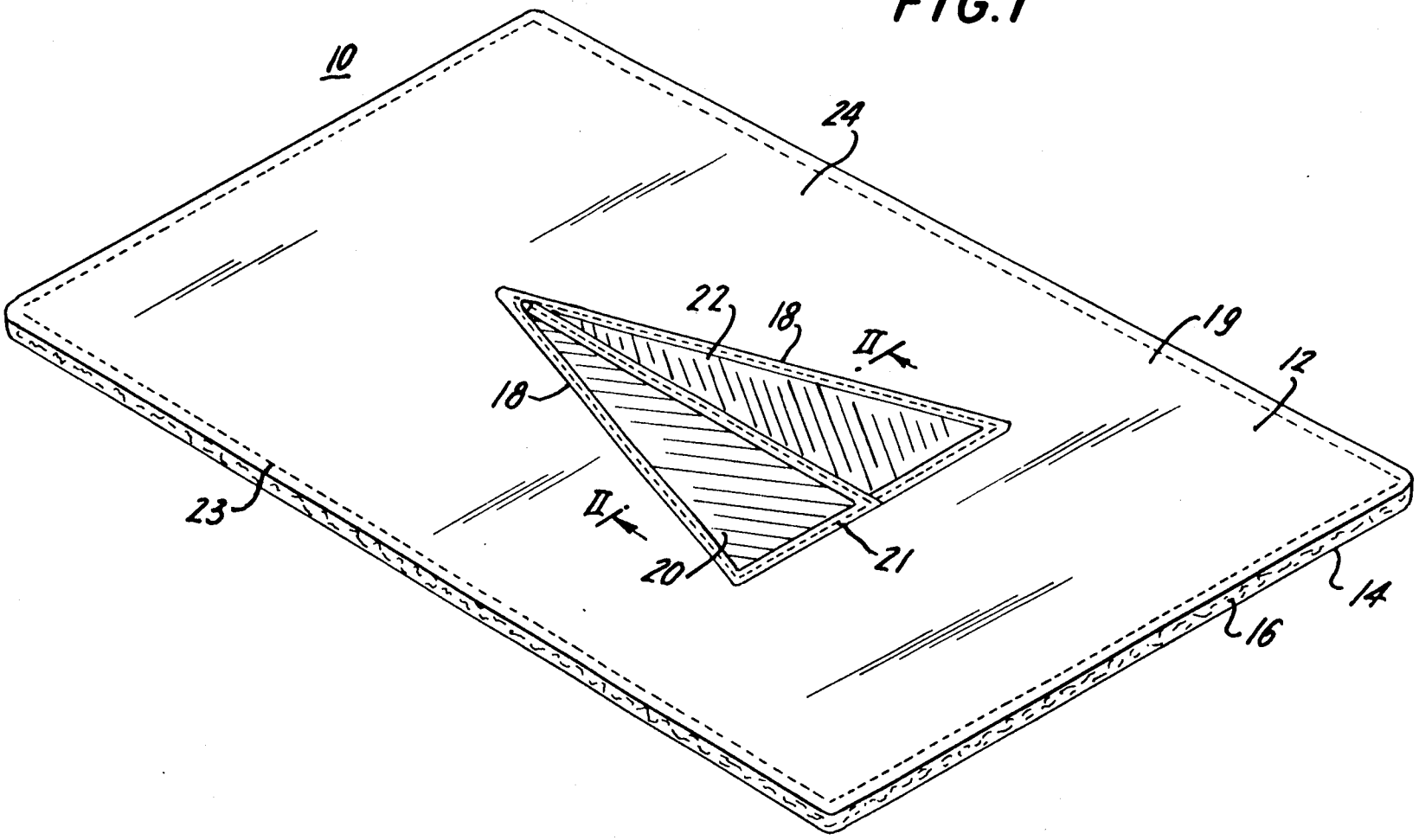
FIG. 1 is a schematic perspective view of a quilt manufactured according to the method of the present invention.
Figure 2:
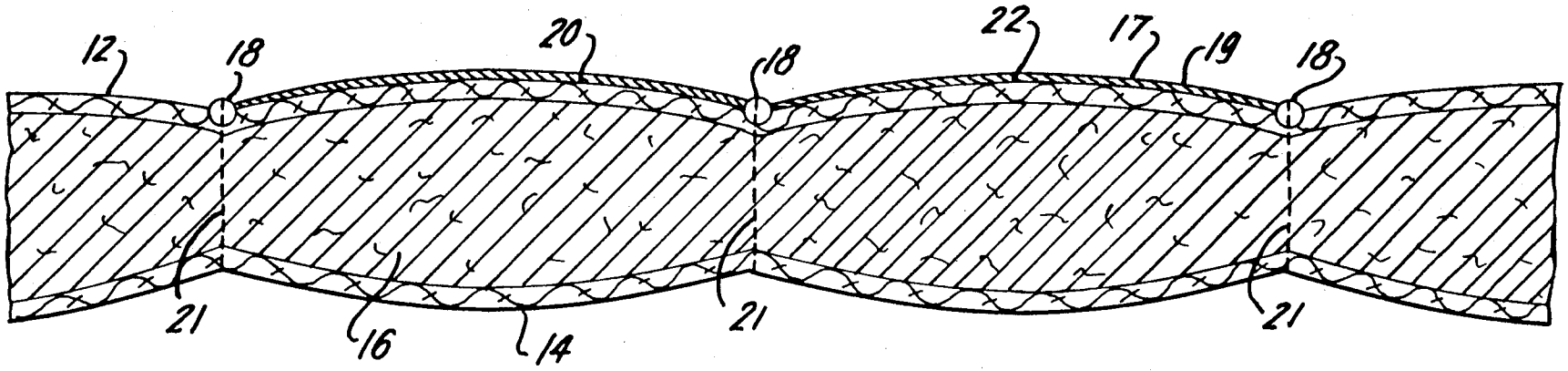
FIG. 2 is a cross-sectional view of the quilt illustrated in FIG. 1, taken along line 2—2 thereof.

The present invention is intended for use particularly with quilted products such as a comforter 10 or a pillow (not shown). Referring to FIG. 1, comforter 10 is multi-layered, typically having a facing sheet 12, a backing sheet 14 and a batting layer 16 sandwiched between facing sheet 12 and backing sheet 14. Significant savings of time and reduced waste are achieved by first superimposing on one another, in the order stated, facing sheet 12, batting layer 16 and backing sheet 14. Sheets 12 and 14 and layer 16 are simultaneously affixed to one another when cording 18 is positioned and stitched on section by section by a programmable drum quilter (not shown). Specifically, the drum quilter lays down cording 18 on upper surface 19 of facing sheet 12 in accordance with a predetermined decorative pattern, and stitches through cording 18, facing sheet 12, backing sheet 14 and batting layer 16 with a stitching thread 21, after or during the positioning of each section of cording 18. Additional threads 23 are also preferably provided, such as around the periphery of comforter 10.

Figure 3:
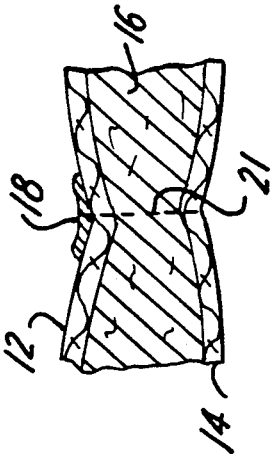
FIG. 3 is a cross-sectional view similar to FIG. 2, showing a cording material with a substantially flat cross-sectional configuration.

Cording 18 can be applied in a single length or as a plurality of lengths, typically having a diameter of from one-eight to about one-quarter of an inch of round cording and similar in design to a round shoe lace. However, other materials such as flat cord and flat lace (FIG. 3) have been successfully used for cording 18. In addition, the process can use any suitable materials for facing sheet 12, backing sheet 14 and batting layer 16 that are commonly used in the quilting industry.

The application of cording 18 can be accomplished using any of the single or multi-needle quilting machines of either the flat bed or drum variety which are presently known. These and similar machines can be interfaced with a computer controlling mechanism which directs the positioning and the stitching of cording 18 in accordance with any desired programmed pattern.

After the stitching process, comforter 10 is removed from the drum quilter and a paint 17 or similar fabric dye is applied by any of the conventionally known means to areas 20 and 22 (as an example) on surface 19 of facing sheet 12, which areas have been defined by cording 18.

Referring further to FIG. 1, the shaded portions of area 20 and area 22, defined by cording 18, are shaded to represent different colors of paint 17. Among the commonly known methods for applying paints and dyes to fabric, are included manual painting with a brush, drawing with a marker, and automatic machine painting using brushes connected to an applicator bottle. In the latter case, the brushes may be either of the bristle type, foam type, felt type, or a type having a specially fitted air brush. In any event, cording 18 provides a barrier and guide for the paint application. A person applying paint 17 to area 20, for example, is able to work quickly using cording 18 as a physical barrier to prevent misapplying the paint into area 22 or to outer area 24 beyond cording 18, which would normally occur due to sloppy painting, accidental slips or excess paint on the brushes. Additionally, automated paint applicators could be programmed to paint within the physical borders provided by cording 18. Such an automated paint applicator could be equipped to detect the cording border by the use of tactile sensors or by use of a visual sensor programmed to identify the cording. Thus, with the present invention, the entire painting process can be completed in less than fifteen minutes to achieve a perfectly painted design.

Further, by changing the cording color, dramatically different design effects can be achieved without changing the design or painted color.

The above process ensures a great degree of consistency of design and quality and provides reproducibility suitable for mass merchandising and catalog sales. Because the desired pattern can be reproduced to within machine tolerances of up to ±0.005 inch, the bordering provided by cording 18 is easily used to guide the paint applicator. This process thus eliminates the need for stencilling on a design first. Additionally, there is practically no limitation to the colors of cording which may be interchanged in infinite combinations with an infinite number of paint colorings.

It will be understood that the embodiment described herein is merely exemplary and that a person skilled in the art may make many variations, combinations and modifications without departing from the spirit and scope of the invention. For instance, comforter 10 could be provided with smaller dimensions suitable for a pillow covering or so as to be suitable for a wall hanging. Furthermore, cording 18 may be substituted with lace or other suitable fabrics.

As another modification, for example, the facing sheet, backing sheet and cording material can be sewn together, with the cording material being in a predetermined design. Thereafter, paint can be applied, and then, a filler material, such as a batting material, can be blown in or otherwise placed between the facing sheet and backing sheet. Other variations can also be utilized, provided that the cording material is sewn prior to the painting operation.

All such modifications and variations are intended to be included within the scope of the invention as defined in the appended claims.

What is claimed is:

1. A process for manufacturing a quilt having a decorative design thereon, including the steps of:

sandwiching batting material between a facing sheet and a backing sheet;

positioning at least one extended length of decorative cording material on said facing sheet in a predetermined decorative pattern;

providing a substantial barrier against colorant migration by stitching through said at least extended length of decorative cording material, said facing sheet, said batting material and said backing sheet such that said cording material functions as said substantial barrier; and applying a colorant to said facing sheet within an area defined by said at least one extended length of decorative cording material, so as to form said decorative pattern, with said cording material functioning as said substantial barrier to colorant migration.

2. A process in accordance with claim 1, wherein said cording material has a substantially circular cross-sectional configuration.

3. A process in accordance with claim 2, wherein said cording material has a diameter in the range of about ⅛ to ¼ inch.

4. A process in accordance with claim 1, wherein said cording material has a substantially flat cross-sectional configuration.

5. A process in accordance with claim 1, wherein said step of applying a colorant includes the step of painting said facing sheet within said area.

6. A process for manufacturing a sheet of material having a decorative design thereon, including the steps of:

positioning at least one extended length of decorative cording material on said sheet of material in a predetermined decorative pattern;

providing a substantial barrier against colorant migration by stitching through said at least one extended length of decorative cording material and said sheet of material such that said cording material functions as said substantial barrier; and applying a colorant to said sheet of material within an area defined by said at least one extended length of decorative cording material, so as to form said decorative pattern, with said cording material functioning as said substantial barrier to colorant migration.

7. A process in accordance with claim 6, wherein said cording material has a substantially circular cross-sectional configuration.

8. A process in accordance with claim 7, wherein said cording material has a diameter in the range of about ⅛ to ¼ inch.

9. A process in accordance with claim 6, wherein said cording material has a substantially flat cross-sectional configuration.

10. A process in accordance with claim 6, wherein said step of applying a colorant includes the step of painting said facing sheet within said area.

11. A process in accordance with claim 6, further including the step of sewing said sheet of material to a backing sheet with a filler material therebetween.

12. A process for manufacturing a quilt having a decorative design thereon, including the steps of:

positioning a facing sheet on a backing sheet;

positioning at least one extended length of decorative cording material on said facing sheet in a predetermined decorative pattern;

providing a substantial barrier against colorant migration by stitching through said at least one extended length of decorative cording material, said facing sheet, and said backing sheet such that said cording material functions as said substantial barrier;

applying a colorant to said facing sheet within an area defined by said at least one extended length of decorative cording material, so as to form said decorative pattern, with said cording material functioning as said substantial barrier to colorant migration; and placing filler material between said facing sheet and said backing sheet.

13. A process in accordance with claim 12, wherein said cording material has a substantially circular cross-sectional configuration.

14. A process in accordance with claim 13, wherein said cording material has a diameter in the range of about ⅛ to ¼.

15. A process in accordance with claim 12, wherein said cording material has a substantially flat cross-sectional configuration.

16. A process in accordance with claim 12, wherein said step of applying a colorant includes the step of painting said facing sheet within said area.

17. A process for manufacturing a quilt having a decorative design thereon, including the steps of:

sandwiching batting material between a facing sheet and a backing sheet;

positioning at least one extended length of decorative cording material on said facing sheet in a predetermined decorative pattern;

providing an edge guide for a colorant applicator by stitching through said at least one extended length of decorative cording material, said facing sheet, said batting material and said backing sheet such that said cording material functions as said edge guide; and applying a colorant to said facing sheet within an area defined by said at least one extended length of decorative cording material by guiding the colorant applicator against the cording material, so as to form said decorative design.

18. A process in accordance with claim 17, wherein said cording material has a substantially circular cross-sectional configuration.

19. A process in accordance with claim 18, wherein said cording material has a diameter in the range of about 3/16 to ¼ inch.

20. A process in accordance with claim 17, wherein said cording material has a substantially flat cross-sectional configuration.

21. A process in accordance with claim 17, wherein said step of applying a colorant includes the step of painting said facing sheet within said area.

22. A process for manufacturing a sheet of material having a decorative design thereon, including the steps of:

positioning at least one extended length of decorative cording material on said sheet of material in a predetermined pattern;

providing an edge guide for a colorant applicator by stitching through said at least one extended length of decorative cording material and said sheet of material such that said cording material functions as said edge guide; and applying a colorant to said sheet of material within an area defined by said at least one extended length of decorative cording material by guiding the colorant applicator against the cording material, so as to form said decorative design.

23. A process in accordance with claim 22, wherein said cording material has a substantially circular cross-sectional configuration.

24. A process in accordance with claim 23, wherein said cording material has a diameter in the range of about 3/16 to ¼ inch.

25. A process in accordance with claim 22, wherein said cording material has a substantially flat cross-sectional configuration.

26. A process in accordance with claim 22, wherein said step of applying a colorant includes the step of painting said facing sheet within said area.

27. A process in accordance with claim 22, further including the step of sewing said sheet of material to a backing sheet with a filler material therebetween.

28. A process for manufacturing a quilt having a decorative design thereon, including the steps of:

positioning a facing sheet on a backing sheet;

positioning at least one extended length of decorative cording material on said facing sheet in a predetermined decorative pattern;

providing an edge guide for a colorant applicator by stitching through said at least one extended length of decorative cording material, said facing sheet and said backing sheet such that said cording material functions as said edge guide;

applying a colorant to said facing sheet within an area defined by said at least one extended length of decorative cording material by guiding the colorant applicator against the cording material, so as to form said decorative design; and placing filler material between said facing sheet and said backing sheet.

29. A process in accordance with claim 28, wherein said cording material has a substantially circular cross-sectional configuration.

30. A process in accordance with claim 29, wherein said cording material has a diameter in the range of about 3/16 to ¼ inch.

31. A process in accordance with claim 28, wherein said cording material has a substantially flat cross-sectional configuration.

32. A process in accordance with claim 28, wherein said step of applying a colorant includes the step of painting said facing sheet within said area.

* * * * *